United States Patent [19]

Morgand

[11] Patent Number: 4,692,942

[45] Date of Patent: Sep. 8, 1987

[54] ELECTROACOUSTIC TRANSDUCER WITH PIEZOELECTRIC DIAPHRAGM

[75] Inventor: Jean P. Morgand, La Celle sur Loup, France

[73] Assignee: Thomson CSF, Paris, France

[21] Appl. No.: 790,451

[22] Filed: Oct. 23, 1985

[30] Foreign Application Priority Data

Oct. 30, 1984 [FR] France ..... 84 16594

[51] Int. Cl.[4] ..... H04C 17/02

[52] U.S. Cl. ..... 381/114; 381/88; 381/173; 381/188; 381/205

[58] Field of Search ..... 381/114, 113, 91, 88, 381/173, 188, 205; 179/110 A, 187; 310/324, 353, 356

[56] References Cited

U.S. PATENT DOCUMENTS 3,660,602 5/1972 Thompson ..... 381/114

4,409,441 10/1983 Murray ..... 179/111 E 4,607,145 8/1986 Ravinet ..... 179/110 A

FOREIGN PATENT DOCUMENTS 2064264 6/1981 United Kingdom ..... 381/113

*Primary Examiner*—Gene Z. Rubinson

*Assistant Examiner*—L. C. Schroeder

*Attorney, Agent, or Firm*—Cushman, Darby & Cushman

[57] ABSTRACT

The invention relates to electroacoustic transducers and more particularly to microphones in which the conversion of an acoustic vibration into an electric voltage is provided by a piezoelectric diaphragm. The purpose of the invention is to allow transducers to be formed by mass production methods with a minimum of parts for providing the functions of embedment of the diaphragm, connections, screening, acoustic filtering and protection against damp and dust.

6 Claims, 4 Drawing Figures

ELECTROACOUSTIC TRANSDUCER WITH PIEZOELECTRIC DIAPHRAGM

BACKGROUND OF THE INVENTION

1. Field of the Invention

The present invention relates to electroacoustic transducers for converting an acoustic pressure into an electric voltage. It relates more particularly to microphones in which the conversion of an acoustic vibration into an electric voltage is provided by a piezoelectric polymer vibrating element.

2. Description of the Prior Art

Different models of electroacoustic transducers of this type are known. There may be mentioned as forming part of the state of the art a transducer described in a patent application filed by the applicant on the Aug. 11, 1981 and published under the U.S. Pat. No. 2,511,570.

This transducer uses a resilient structure in the form of an embedded plate having at least one incurvation and convered on both its faces with electrodes connected to an electric impedance matching circuit. It is formed from an assembly of elements arranged according to an original principle which confers excellent qualities thereon. However, the relative high number of these elements and the method of assembling them are not satisfactory for high rate and low cost mass production of these transducers.

These considerations led the applicant to file on the Mar. 7th, 1983 patent application filed under the n° 83.93 697 concerning an electroacoustic transducer formed from a limited number of elements which allow the combination of means providing the functions of embedding the vibrating element, internal and external connections, screening, acoustic filtering and protection against damp and dust. However, for reasons of electric insulation and accuracy during mounting this transducer requires an insulating jacket of a more or less complicated shape depending on the quality required for the transducer. The presence of this jacket and positioning thereof leads to a high cost price of this type of transducer.

In order to overcome these drawbacks, the invention provides an electroacoustic transducer with a piezoelectric diaphragm whose main elements are designed in an original way so as to avoid the need to use an insulating jacket and so as to efficiently provide the functions of embedding the vibrating element, of electric connections and acoustic filtering.

SUMMARY OF THE INVENTION

The invention provides then an electroacoustic transducer whose vibrating element is formed by a piezoelectric diaphragm subjected to the acoustic pressure on one at least of its faces, each face being covered with an electrode connected to an electric circuit disposed on a printed circuit, the diaphgram and the electric circuit being enclosed in a case formed by a tubular shaped body whose bottom is a pierced wall corresponding to the front face of the transducer, said body and a spacer ensuring embedment of the diaphragm, said printed circuit closing the transducer on the rear face of said body and positioning the spacer, the electric connection means being provided by the body and the spacer, wherein said spacer is a hollow bell shaped structure whose large base in the form of a ring presses the diaphragm against a shoulder of the body for embedding same and whose small base is fixed to the center of the printed circuit.

BRIEF DESCRIPTION OF THE DRAWINGS

The invention will be better understood and other advantages will be clear from the following description and the accompanying Figures in which.

DESCRIPTION OF THE PREFERRED EMBODIMENT

The following description will relate more specifically to a microphone capsule but without departing from the scope of the invention the structure of this capsule is applied to the most general case: microphones with flat or non flat mineral or polymer piezoelectric diaphragm, embedded or held by any other fixing means between jaws. The invention is also applicable to the cases of transducers operating as emitters.

Microphone capsules or earphones generally comprise a piezoelectric diaphragm deformable under the action of the acoustic pressure which is applied thereto and whose periphery is fixed to at least one rigid piece surrounding it and forms the support. Under the action of an acoustic pressure, the diaphragm is deformed and a potential difference appears between its main faces which are provided with electrodes. This potential difference is then amplified for providing the output signal of the device. At the present time, the diaphragm is generally formed from a foil of piezoelectric polymer such as vinylidene bifluoride ($PVF_2$), or copolymer. This foil is embedded by its periphery at the upper part of a case whose lower part is closed by a printed circuit carrying a preamplifier. Acoustic damping means correct the frequency response by avoiding the resonance peaks of the first natural modes of the diaphragm.

Figure 1:
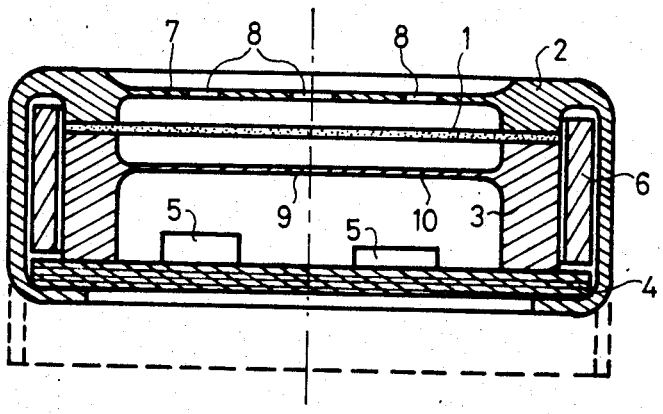
FIG. 1 is a sectional view of a microphone capsule of the prior art.

FIG. 1 is a view in meridian section of a microphone capsule of the prior art. The active part of the capsule is formed by the piezoelectric diaphragm 1 covered on its upper and lower faces with metallizations serving as electrodes. Diaphragm 1 is clamped along its periphery between body 2 and spacer 3 which play the role of fixing parts. Parts 2 and 3 are made from metal and also provide the electric connections between the electrodes of the diaphragm and the double face printed circuit 4. Body 2 froms the upper part and the sides of the capsule. The printed circuit forms the bottom of the capsule. On its internal face it has electronic componets 5 forming a preamplifier and on its outer face pins, not shown, for connecting the capsule to a connection cable. The upper electrode of the diaphragm, body 2 and the external face of the printed circuit 4 form a first equipotential which screens the diaphragm and the components 5. The lower electrode of the diaphragm, spacer 3 and the internal face of the printed circuit form the second equipotential. The annular jacket 6 provides electric installation of body 2 with respect to spacer 3.

As shown in FIG. 1, the body 2 and spacer 3 may be used advantageously for defining on each side of the diaphragm cavities and walls pierced with orifices for synthesizing acoustic components adapted for regularizing the response curve of the microphone. The acoustic components are materialized by the wall 7 of body 2, this wall being pierced with holes 8 and by the wall 10 of the space 3, this wall being pierced with the hole 9.

The assembly of the capsule is facilitated by the fact that the symmetry of revolution is kept throughout: the relative positioning of the different parts forming the capsule is thus provided simply by stacking them and by their concentricity. Body 2 has initially, in its lower part, the tubular geometry shown with broken lines. The order of the assembly operations is the following: the body receives first of all the annular insulating jacket 6 which then allows diaphragm 1 and spacer 3 to be centered. The printed circuit 4 with its soldered components is then positioned, the components being situated inside the capsule. Clamping of the stack and the embedment is achieved by crimping body 2 to the external face of the printed circuit.

Moreover, in order to increase the sensitivity of the capsule it is known that the diaphragm must have a bulding shape so as to have a concave or convex dome. The embedment plane in this case is slanted with a preestablished slope calculated according to the camber-diameter ratio to be given so as to obtain a sensitivity which is as little dependent as possible on the temperature.

The side part of body 2 and spacer 3 are coaxial over a large part of the height of the case, which requires the presence of the insulating jacket 6 made from a material having a low dielectric constant. By the choice of this material, the parasite capacity between the body and the spacer may thus be reduced. It is also possible to form recesses in the insulating jacket so as to reduce the parasite capacity existing between the body and the spacer but this complicates the construction of the jacket and increases the cost price of the capsule.

As was mentioned above, the transducer of the invention does not use an insulating jacket. The fact of not providing an insulating jacket raises the problem of the electric insulation of the body and of the spacer and of the form which should be given to this latter so that assembly of the capsule provides at the same time the electric insulation, acoustic damping and tolerance to temperature variations sufficient for obtaining the required performances.

Figure 2:
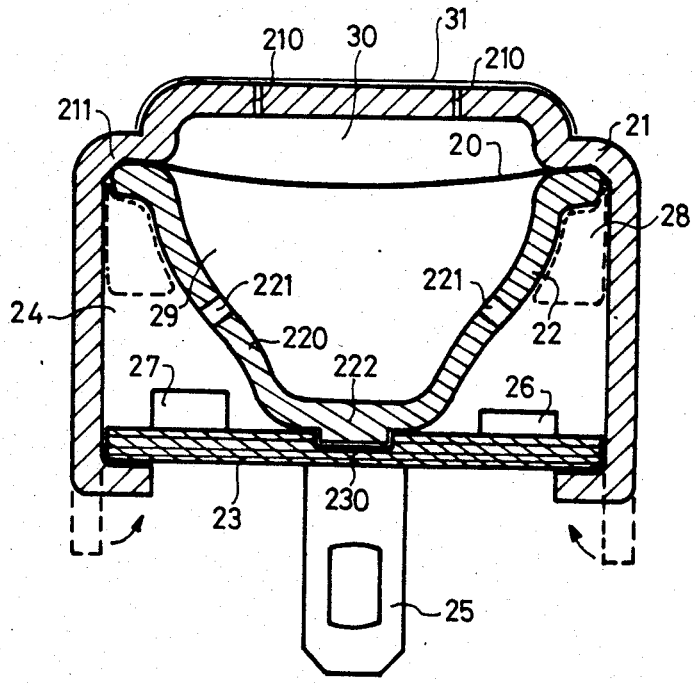
FIGS. 2 and 3 are sectional views of microphone capsules in accordance with the invention.

FIG. 2 shows a first embodiment of the capsule of the invention. It is a view in meridian section. The capsule comprises, besides the piezoelectric diaphragm 20 three main parts: a metal body 21 forming the case and the ground electrode, a metal cup 22 forming the spacer and transmitting the electric signal induced in the diaphragm by an incident acoustic pressure, and a printed circuit 23 forming the bottom of the case.

The diaphragm is metallized on its two main faces. One if its electrodes comes into contact with case 21 whereas the other is in contact with the cup 22. The spacer has a large base in contact with the diaphragm and a small base in contact with the printed circuit. The spacer or cup 22 has the form of a funnel which allows an airspace to be left between the lateral parts of the body 21 and said spacer sufficient for obtaining acceptable electric insulation and reduced parasite capacity. The cup is mounted so as to be clamped, after crimping of the body on the printed circuit, between a shoulder 211 of the body and the printed circuit on which it bears along the axis of symmetry of the capsule. The cup is fixed to the printed circuit for example by a tenon and mortice type assembly. Tenon 222 and mortice 230 may be cylindrical in shape so as to comply with the overall symmetry of the capsule. Under the effect of temperature variations, spacer 22 expands or contracts which may cause disturbing stresses at the level of the diaphragm. To overcome this disadvantage, the wall of the spacer may be profiled so as to have at least one inflection 220. The mechanical stresses due to temperature variations will appear then mainly in the inflection zone. The wall may be further pierced at certain positions with holes 221. The number, distribution and diameter of these holes allow an acoustic filter to be synthesized between the two cavities 24 and 29 so as to correct the frequency response of the transducer. Similarly, the front part of the body is pierced with holes 210 and forms with cavity 30, defined by this front part of the diaphragm, another acoustic filter. It is advantageous to bond to the front part of the ease a protective film or tissue 31 so as to prevent dust or damp from penetrating inside the capsule. To improve the electric insulation, an annular cushion 28 shown with broken lines in the Figure and made from a flexible and insulating material may be placed between the most closely related parts of the body and of the cup.

One of the output terminals 25 has been shown which are plugged into the double face printed circuit 23 and which are connected one to the internal face of the printed circuit and the other to its external face. The printed circuit 23 may have on its internal face the components of the preamplifier, essentially the input resistor 26 of several megohms and the chip carrier 27 comprising a two transisitor Darlington circuit or a field effect transistor.

As is known, diaphragm 20 has preferably a bulging shape either before or during assembly so as to increase the sensitivity of the transducer. The thickness of the diaphgram is chosen so as to be at the maximum of sensitivity for a given diameter which determines its active capacity. The shoulder 211 and the facing edge of spacer 22 are slanted so as to form a conical bearing surface so as to nip the diaphragm at the desired angle. The diaphragm is held in position by machining the related parts of elements 21 and 22 with a sharp angle.

The volume limited by the diaphragm, the body and the printed circuit is closed. So as to avoid an increase of the pressure of the air enclosed in this volume, it is necessary to provide static pressure equalizing leaks. Instead of piercing a through hole in the printed circuit, it is possible to provide radial capillary leaks or vents breaking the clamping seal of the body crimped to the printed circuit. The etching of the two faces of the circuit is such that air passages are created in the thickness of the copper layer of the printed circuit. The rear cavity of the microphone is thus connected to the atmospheric pressure. These capillary leaks have a sufficiently high acoustic impedance so as not to disturb the response of the microphone even at low frequencies.

A variant will consist in providing a cup made from an insulating material and some parts of which will be metallized (the ring in contact with the diaphragm, the zone of contact with the printed circuit) so as to provide an electric connection between the diaphragm and the printed circuit. The electric continuity could be provided by metallizing the holes 221. This variant has the advantage of reducing the parasite capacity between the body and the spacer. In this case, the cushion 28 may be omitted.

The transducer of the invention has electroacoustic characteristics equivalent to the transducer of the known art shown in FIG. 1 but has one element less, namely the insulating jacket. Furthermore, the acoustic means for shaping the response curve and in particular for damping the first resonance are simplified.

Figure 3:
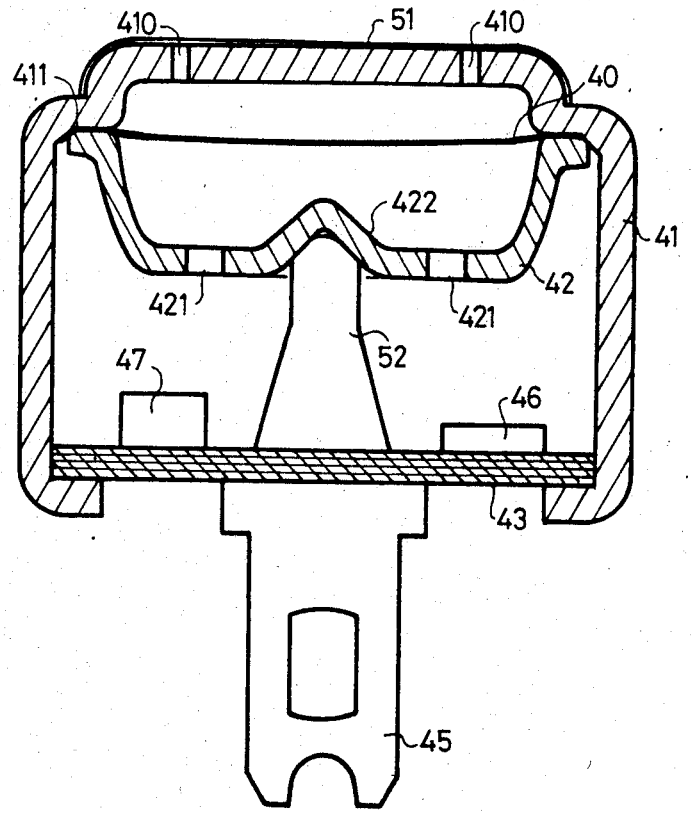

FIG. 3 is a meridian sectional view of a second embodiment of the capsule of the invention. This capsule differs from the one shown in FIG. 2 by the form of the spacer which is made in two parts and by the way in which it bears on the printed circuit. Body 41 is identical to the one of FIG. 2. Its front part is pierced with holes 410 and is covered with a protective tissue 51. The body has a shoulder 411 intended to receive the diaphragm 40. As before the diaphragm is metallized on its two main faces. One of its electrodes is in contact with the case or body 41 whereas the other is in contact with the upper part of the spacer or cup 41. As before, the case is closed by crimping the body to the double face printed circuit 43 which carries the components 46 and 47 of the preamplifier. One of the output terminals 45 has also been shown which are plugged into the printed circuit 43.

The capsule differs from that shown in FIG. 2 by the presence of an additional element, support 52 formed from a metal part mounted on the printed circuit along the axis of revolution of the capsule and forming the lower part of the spacer. Support 52 bears on cup 42, which in its turn bears on the diaphragm along its peripheral ring. Since the cup and support 52 are made from a conducting material, the electric connection between the diaphragm and the printed circuit is provided. So as to facilitate assembly of the capsule, the center of cup 42 has a re-entrant shape 422 which mates with the upper part of support 52. Holes 421 have been pierced in the cup so as to form an acoustic filter. The re-entrant form 422 of the cup contributes to reducing the harmful influence of stresses due to the temperature variations of the cup with respect to the diaphragm. The capsule is assembled in the following way. The electronic elements 46 and 47 are soldered to the printed circuit on which support 52 is also fixed, for example by crimping or soldering. The different elements are stacked in body 41 in the following order: diaphragm, cup, printed circuit equipped with the support 52. The diaphragm is automatically centered to shoulder 411. Crimping of the edge of the body on the printed circuit clamps the whole together.

As before, the cup 42 may be made from metal or made form a dielectric material metallized on certain parts so as to provide both the electric continuity and a reduction of the parasite capacity.

In a variant, the center of cup 42 may be pierced with a circular hole. Support 52 may have one end of a pyramidal shape whose dimensions are such that the support fits into the central hole of the cup and applies this latter against the diaphragm. In this case, an air leak exists between the inside and outside of the cup and holes 421 are no longer needed.

The electroacoustic properties of a microphone capsule of the first embodiment will not be described. Its characteristics are the following: outer diameter of the body 11 mm, angle of fixing the diaphragm about 7°, sharp angle of the shoulder 45° with respect to the horizontal, body and spacer made from aluminimum alloy, diaphragm made form vinylidene bifluoride ($PVF_2$) of a thickness of 120 $\mu$m, input resistance of the preamplifier 10 megohms, three orifices in the front face of a diameter of 0.3 mm and no holes in the spacer. The active capacity of the diaphragm is then equal to 42 pF and the parasite capacity is twice as small.

Figure 4:
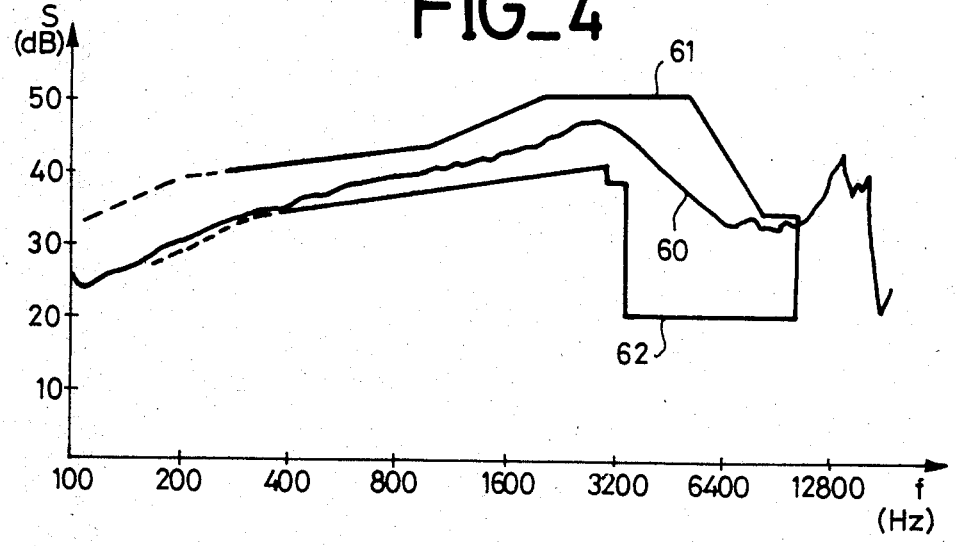
FIG. 4 is a diagram showing the sensitivity of a capsule of the invention as a function of the frequency.

FIG. 4 is a diagram showing the response curve obtained with such a capsule. The ordinate axis represents the sensitivity S in decibels whose origin is arbitarily chosen. The abscissa axis represents the frequency in hertz on a logarithmic scale. The curve obtained bears the reference 60. The sensitivity at 1000 Hz is equal to 1 $\mu$V/Pa. There is also shown, limited by curves 61 and 62, the gauge imposed by the French Post Office.

With the invention, microphone capsules having the performance required by generally accepted standards and particular those in force in France may be obtained by mass production methods and at a low cost.

What is claimed is:

1. An electroacoustic transducer assembly comprising:

tubular shaped metal body means having an open end and a closed end, said closed end having a plurality of holes formed therein to admit accoustic pressure, said body means further defining an inwardly extending shoulder portion proximate said closed end;

metal cup means having a small base with a tenon projection extending outwardly therefrom, and a large ring shaped open end;

piezoelectric diaphragm means for mounting between said shoulder of said body means and said ring shaped open end of said cup means; and circuit board means for mounting in said open end of said body means, said tenon projection extending into a mortice in said circuit board means, whereby said circuit board means secures said cup means against said metal body means.

2. The electroacoustic transducer assembly as claimed in claim 1, wherein said diaphgram is embedded between said body means and said cup means at a sharp angle.

3. The electroacoustic transducer assembly as claimed in claim 1, wherein said metal cup means is made from a dielectric material, and a metallized coating provides the electric connection between the diaphragm means and the circuit board means.

4. The electroacoustic transducer assembly as claimed in claim 1, wherein said circuit board means is provided with vents for equalizing pressures on each face of said circuit board means.

5. The electroacoustic transducer assembly as claimed in claim 1, wherein an insulating cushion is inserted between the body means and the cup means.

6. The electroacoustic transducer assembly as claimed in claim 1, wherein the wall of the cup means comprises at least one inflection for minimizing the stresses due to temperature variations.

* * * * *